US008870335B2

(12) United States Patent
Andoh

(10) Patent No.: US 8,870,335 B2
(45) Date of Patent: Oct. 28, 2014

(54) LIQUID DISCHARGE STATE DETECTION DEVICE AND IMAGE FORMING APPARATUS

(71) Applicant: Hiroshi Andoh, Ibaraki (JP)

(72) Inventor: Hiroshi Andoh, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/707,825

(22) Filed: Dec. 7, 2012

(65) Prior Publication Data

US 2013/0147874 A1 Jun. 13, 2013

(30) Foreign Application Priority Data

Dec. 9, 2011 (JP) ..... 2011-269939

(51) Int. Cl.
*B41J 29/393* (2006.01)
*B41J 2/195* (2006.01)
*B41J 2/165* (2006.01)

(52) U.S. Cl.
CPC ..... *B41J 2/195* (2013.01); *B41J 2/16579* (2013.01)
USPC ..... 347/19

(58) Field of Classification Search
CPC . B41J 2/04526; B41J 2/04561; B41J 2/16579
See application file for complete search history.

(56) References Cited

U.S. PATENT DOCUMENTS 5,760,900 A * 6/1998 Ito et al. ..... 356/338
6,305,777 B1 * 10/2001 Lee ..... 347/19
2003/0107734 A1 * 6/2003 Davis et al. ..... 356/338
2003/0151734 A1 * 8/2003 Donahue et al. ..... 356/71
2004/0036856 A1 * 2/2004 Wittman et al. ..... 356/73
2009/0059227 A1 * 3/2009 Plant ..... 356/364
2010/0265287 A1 * 10/2010 Govyadinov et al. ..... 347/9

FOREIGN PATENT DOCUMENTS

JP 2003114104 A * 4/2003
JP 2007-118264 5/2007
JP 2009-113225 5/2009
JP 2009-132025 6/2009
JP 2011-189726 9/2011

OTHER PUBLICATIONS

Machine generated English translation of JP2003114104A to Uehara et al., "Missile Position Measuring Method and Device," generated via http://www19.ipdl.inpit.go.jp/PA1/cgi-bin/PA1INDEX on Jan. 30, 2014; 9 pp.*

* cited by examiner

*Primary Examiner* — Shelby Fidler
(74) *Attorney, Agent, or Firm* — Oblon, Spivak, McClelland, Maier & Neustadt, L.L.P.

(57) ABSTRACT

A liquid discharge state detection device includes a light emitting element that emits a light beam; and a light receiving element that is placed at a position shifted from a beam diameter of the light beam. The light receiving element receives scattered light generated when the light beam collides with a liquid droplet. A discharge state of the liquid droplet is detected based on a received light amount of the received scattered light. The liquid discharge state detection device further includes an analyzer in the forward direction from the light receiving element. The analyzer detects the scattered light having a polarization direction the same as a polarization direction of the light beam emitted by the light emitting element. The light receiving element receives the scattered light that has passed through the analyzer.

16 Claims, 11 Drawing Sheets

LIQUID DISCHARGE STATE DETECTION DEVICE AND IMAGE FORMING APPARATUS

BACKGROUND OF THE INVENTION

1. Field of the Invention

The present invention relates to a liquid discharge state detection device that detects a discharge state of a liquid droplet discharged by a recording head, and an image forming apparatus that includes the liquid discharge state detection device.

2. Description of the Related Art

As an image forming apparatus such as a printer, a facsimile machine, a copier, a plotter, a multifunction peripheral that includes the respective functions thereof or the like, an inkjet recording apparatus or the like is known as an image forming apparatus of a liquid discharge recording type using a recording head that discharges a liquid droplet, for example.

Such an image forming apparatus of a liquid discharge recording type discharges an ink droplet to a recording medium from a recording head, and forms an image ("records", "prints" or the like being also used for the same meaning) on the recording medium. There are two categories of image forming apparatuses of this type, i.e., serial-type image forming apparatuses and line-type image forming apparatuses. In a serial-type image forming apparatus, a recording head discharges ink droplets and forms an image while moving in a main scan direction. In a line-type image forming apparatus, a line-type recording head is used, and the line-type recording discharges ink droplets and forms an image while not moving.

In embodiments, examples of an "image forming apparatuses" of the liquid discharge recording type include apparatuses that cause ink droplets to reach recording media such as paper, thread, fiber, fabric, leather, metal, plastic, glass, wood, ceramics and so forth. "Forming an image" means not only giving an image having the meaning such as characters/letters, a figure, or the like, to a recording medium, but also giving an image having no meaning such as a pattern or the like to a recording medium (merely causing ink droplets to reach a recording medium).

Further, "ink" is not limited to those commonly referred to as ink, and will be used as a general term of all the liquids with which an image can be formed such as those called a recording liquid, a fixing liquid, a resin, a liquid and so forth. An "image" is not limited to a planar one, and examples thereof include an image given to an object that has a three-dimensional shape and a three-dimensional image itself obtained from three-dimensionally shaping a thing.

In such an image forming apparatus, an image quality may be degraded when a problem occurs in discharging ink from a recording head due to an increase in ink viscosity caused by evaporation of a solvent from nozzles, ink droplets being solidified, adhering of dust/dirt, ink getting mixed with air bubbles, and/or the like, since the recording head discharges ink droplets to a recording medium from the nozzles and carries out recording.

In this regard, liquid discharge state detection devices have been known which detect states of liquid being discharged from recording heads. Such liquid discharge state detection devices include one of a direct light type in which a light beam is emitted along a row of nozzles from one side of the row of nozzles of a recording head, a light reception unit is placed which directly receives the light beam at the other side, and thus, it is detected whether liquid is being discharged (see Japanese Laid-Open Patent Application No. 2007-118264 (Patent reference No. 1), for example). Another one is a device of a forward scattered light type in which a light beam is emitted along a row of nozzles from one side of the row of nozzles of a recording head, a light reception unit is placed at a position shifted from the optical axis of the light beam which receives scattered light reflected by a liquid droplet, and thus, it is detected whether liquid is being discharged (see Japanese Laid-Open Patent Application No. 2009-113225 (Patent reference No. 2), and Japanese Laid-Open Patent Application No. 2009-132025 (Patent reference No. 3), for example).

However, in the above-mentioned liquid discharge state detection device of the forward scattered light type of the Patent references No. 2 or 3, the light receiving unit may be affected by reflected light from the recording medium, the recording head or the like or disturbance light (referred to as "noise light"), the signal to noise ratio (SN ratio) between the received light amount of the noise light in the light reception unit and the received light amount of the above-mentioned scattered light in the light reception unit may be degraded, and thus, it may not be possible to detect the state of liquid being discharged from the recording head.

SUMMARY OF THE INVENTION

In an embodiment, a liquid discharge state detection device includes a light emitting element that emits a light beam; and a light receiving element that is placed at a position shifted from a beam diameter of the light beam. The light receiving element receives scattered light generated when the light beam collides with a liquid droplet. A discharge state of the liquid droplet is detected based on a received light amount of the received scattered light. The liquid discharge state detection device further includes an analyzer in the forward direction from the light receiving element. The analyzer detects the scattered light having a polarization direction the same as a polarization direction of the light beam emitted by the light emitting element. The light receiving element receives the scattered light that has passed through the analyzer.

Other objects, features and advantages of the present invention will become more apparent from the following detailed description when read in conjunction with the accompanying drawings.

DETAILED DESCRIPTION OF THE EMBODIMENTS

<Outline of Liquid Discharge State Detection Device 20 of Embodiments>

Figure 1A:
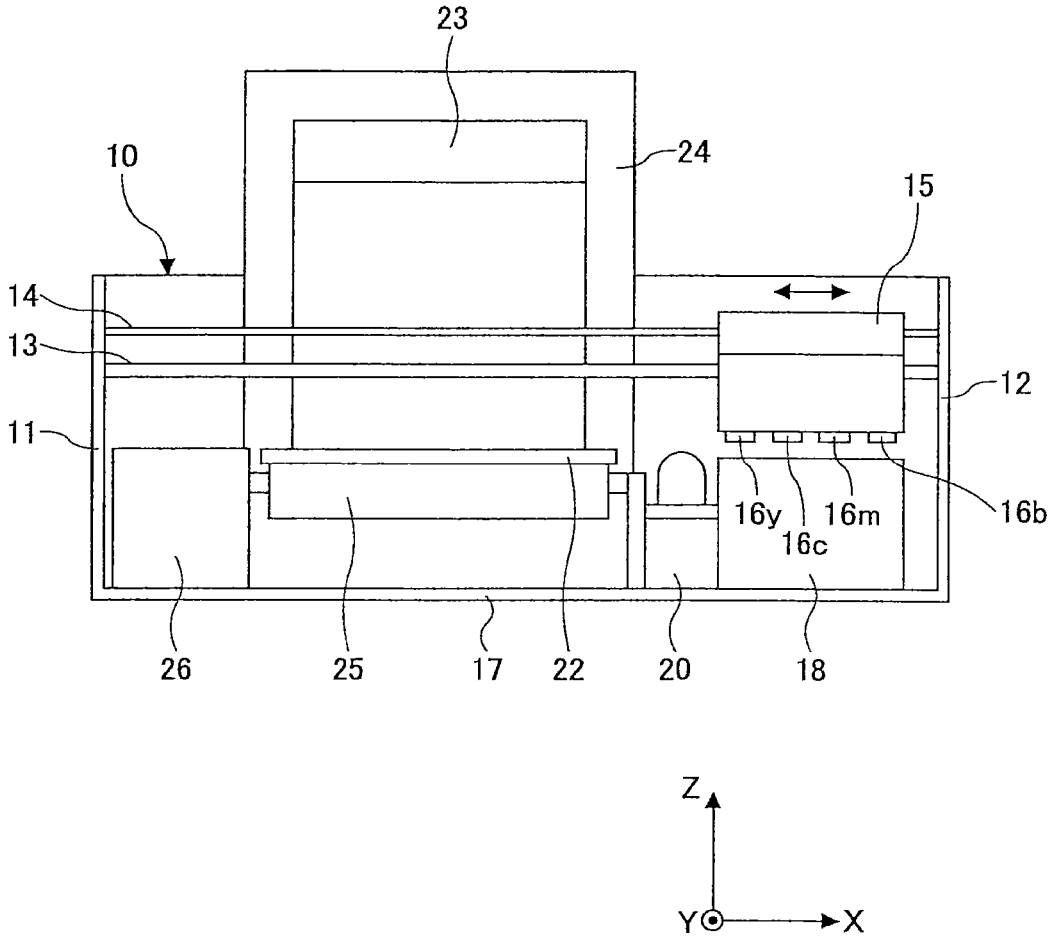
FIGS. 1A and 1B show a general configuration example of an image forming apparatus according to the embodiments.
Figure 1B:
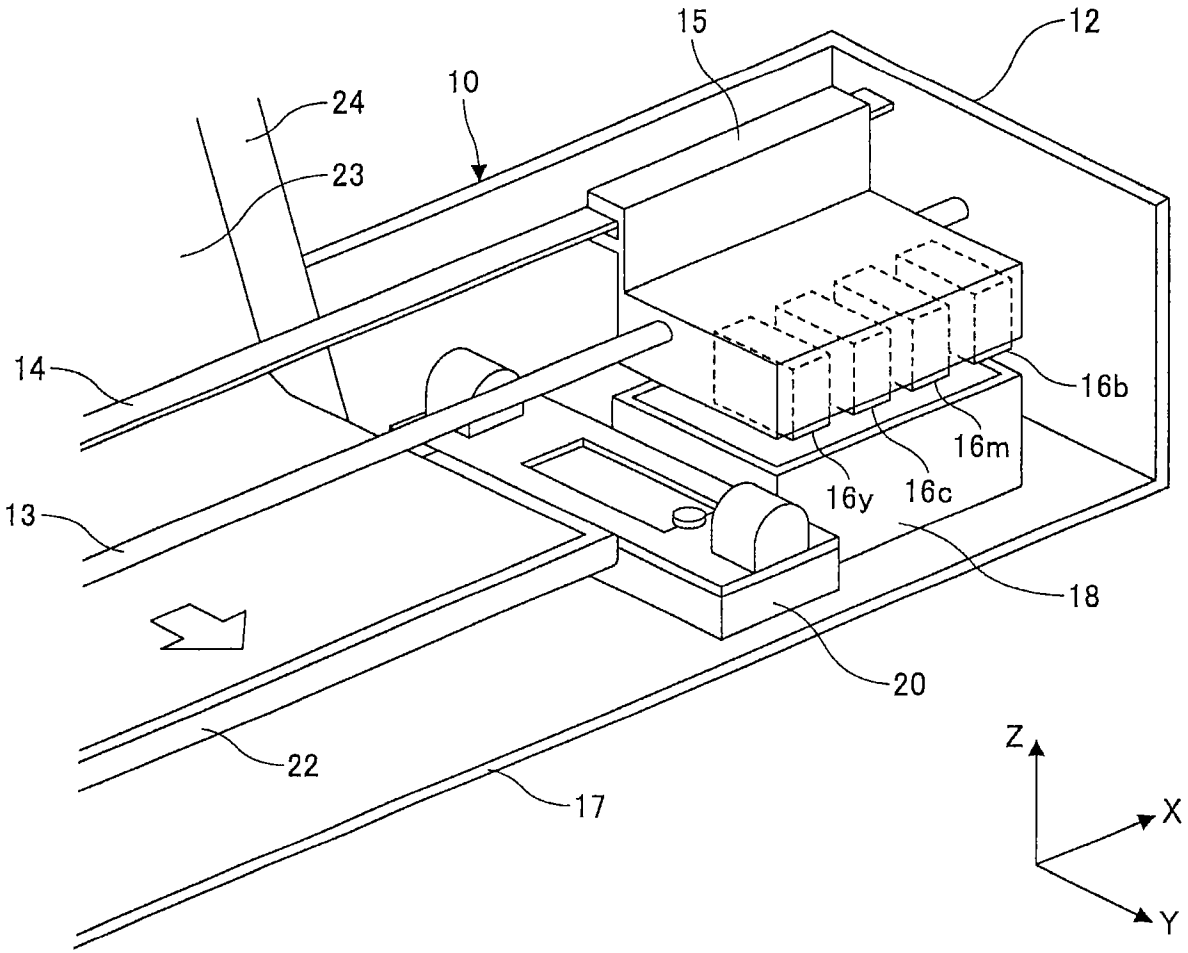
Figure 2:
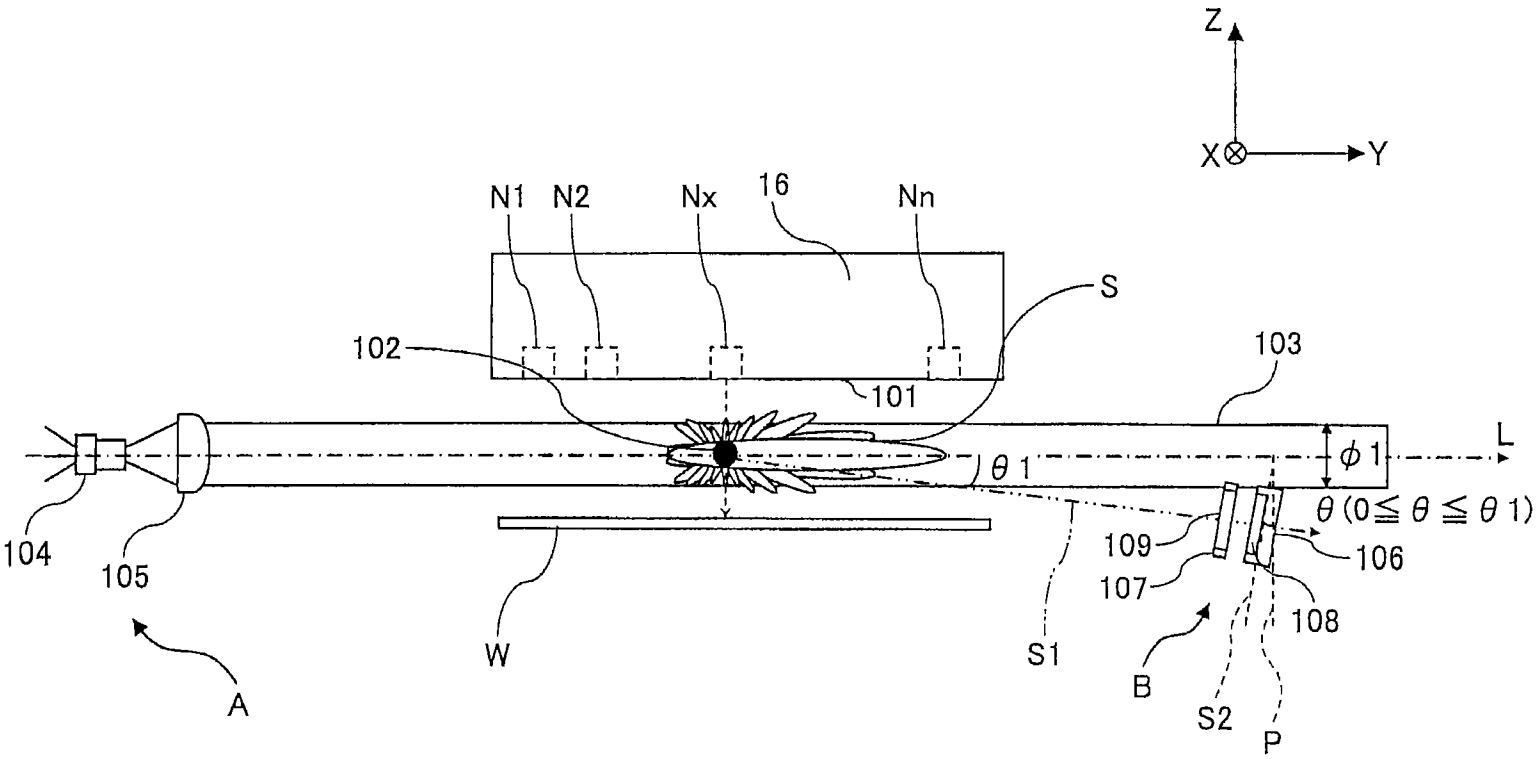
FIG. 2 shows a general configuration example of a liquid discharge state detection device 20 according to a first embodiment.

Referring to FIGS. 1A, 1B and 2, an outline of liquid discharge state detection devices 20 according to the embodiments will be described.

The liquid discharge state detection device 20 is mounted in an image forming apparatus such as that shown in FIGS. 1A and 1B. The liquid discharge state detection device 20 has a light emitting element 104 that emits a light beam 103 and a light receiving element 106 that is placed at a position shifted from a beam diameter ϕ1 of the light beam 103, as shown in FIG. 2. The light receiving element 106 receives scattered light S that is generated when the light beam 103 collides with a liquid droplet (ink droplet) 102, and based on the received light amount of the thus-received scattered light S, the discharge state of the liquid droplet 102 is detected.

The liquid discharge state detection device 20 according to the embodiments includes an analyzer 107 that detects scattered light S having the same polarization direction as the polarization direction of the light beam 103 emitted by the light emitting element 104. The analyzer 107 is placed in the forward direction from the light receiving element 106. The light receiving element 106 receives scattered light S that has passed through the analyzer 107.

The scattered light S generated as a result of the light beam 103 emitted by the light emitting element 104 colliding with the liquid droplet 102 includes the component that has the same polarization direction as the polarization direction of the light beam 103, and this component reaches the light receiving element 106 after passing through the analyzer 107. On the other hand, reflected light of the light beam 103 from a recording medium W, a recording head 16 and/or the like and disturbance light have not been polarized, and thus, the reflected light and the disturbance that reach the light receiving element 106 after passing through the analyzer 107 are reduced. Thus, the SN ratio between the received light amount of the light receiving element 106 by the reflected light of the light beam 103 from the recording medium W, the recording head 16 and/or the like and the disturbance light and the received light amount of the light receiving element 106 by the scattered light S generated as a result of the light beam 103 emitted by the light emitting element 104 colliding with the liquid droplet 102 is increased. Thus, it is possible to detect the discharge state of the liquid droplet discharged from the recording head 16. Below, referring to the accompanying drawings, the liquid discharge state detection devices 20 according to the embodiments will be described in detail.

First Embodiment

<Configuration Example of Image Forming Apparatus>

Referring to FIGS. 1A and 1B, a configuration example of the image forming apparatus according to the embodiments will be described in detail. FIG. 1A shows a view of the image forming apparatus that includes the liquid discharge state detection device 20 viewed from the front side. FIG. 1B shows a view of a part of the image forming apparatus shown in FIG. 1A viewed from an obliquely upward direction.

In the image forming apparatus according to the embodiments, a guide shaft 13 and a guide plate 14 are hung in parallel between right and left side walls 11 and 12 of a housing 10. A carriage 15 is supported by the guide shaft 13 and the guide plate 14. An endless belt (not shown) is fixed to the carriage 15, and is hung and wound between a driving pulley and a driven pulley (both not shown) provided at right and left ends, respectively, in the housing 10. The carriage 15 is moved rightward and leftward in FIG. 1A as shown by arrows (parallel to the X-axis direction) as a result of the driving pulley being driven, the driven pulley being driven by the driving pulley, and thus the endless belt being driven by the driving and driven pulleys.

On the carriage 15, recording heads 16 (including those 16*y*, 16*c*, 16*m* and 16*b* of respective four colors, i.e., yellow, cyan, magenta and black) are mounted, side by side, in the directions (parallel to the X-axis direction) in which the carriage 15 moves. The respective recording heads 16 have nozzle hole rows in each one of which plural nozzles holes (not shown) are arranged, side by side, linearly (parallel to the Y-axis direction) on a nozzle face that faces downward. The linear nozzle hole rows are provided to extend in the direction (parallel to the Y-axis direction) perpendicular to the directions in which the carriage 15 moves.

When the carriage 15 is at a home position of the right end, the respective recording heads 16 face an independent recovery unit 18 that is installed on a bottom plate 17 in the housing 10. The independent recovery unit 18 is a device that, by itself, causes the nozzle hole, for which the liquid discharge state detection device 20 has found an ink discharge problem, to recover from the liquid discharge problem, by suctioning the ink from the nozzle hole.

The liquid discharge state detection device 20 is installed on the bottom plate 17 in the housing 10, and is provided adjacent to the by-itself recovery unit 18. At a position adjacent to the liquid discharge state detection device 20, a plate-like platen 22 is installed. On a back side (−Y-axis direction) of the platen 22, a paper feeding table 24 for feeding a recording medium 23 onto the platen 22 is provided in a state of being obliquely elevated. Although not shown, a paper feeding roller is provided for feeding the recording medium 23 from the paper feeding table onto the platen 22. Further, a conveyance roller 25 is provided to eject the recording medium 23 in the direction of an arrow (parallel to the Y-axis direction) of FIG. 1B to the front side from the platen 22.

On the bottom plate 17 in the housing 10, a driving unit 26 is installed at the left end (see FIG. 1A). The driving unit 26 drives the paper feeding roller (not shown), the conveyance roller 25 and so forth, and also, drives the above-mentioned driving pulley (not shown) to drive the endless belt and move the carriage 15.

At a time of recording, the recording medium 23 is moved onto the platen 22 as a result of the driving operations of the driving unit 26, and is positioned at a predetermined position.

Also, the carriage 15 is moved to scan the recording medium 23. Thus, while the carriage 15 is moving leftward (−X-axis direction), the respective recording heads 16*y*, 16*c*, 16*m* and 16*b* of the four colors are used, in sequence, ink droplets are discharged from the respective nozzle holes onto the recording medium 22, and thus, an image is recorded on the recording medium 23. After the image is thus recorded, the carriage 15 is returned in the right direction (X-axis direction), and also, the recording medium 23 is conveyed by a predetermined amount in the direction (Y-axis direction) of the arrow of FIG. 1B.

Next, an image is again recorded on the recording medium 23 as a result of ink droplets being discharged onto the recording medium 23 from the respective nozzle holes with the use of the recording heads 16*y*, 16*c*, 16*m* and 16*b* of the four colors in sequence while the carriage 15 is being moved leftward (−X-axis direction). After the image is thus recorded, the carriage 15 is returned in the right direction (X-axis direction), and also, the recording medium 23 is conveyed by a predetermined amount in the direction (Y-axis direction) of the arrow of FIG. 1B. Thereafter, the same or similar operations are repeated, and thus, an image is formed on a sheet of the recording medium 23.

<Configuration Example of Liquid Discharge State Detection Device 20>

Next, referring to FIG. 2, a configuration example of the liquid discharge state detection device 20 shown in FIGS. 1A and 1B will be described. FIG. 2 shows a state of the liquid discharge state detection device 20 (of the first embodiment) detecting a discharge problem for an ink droplet discharged from one nozzle hole of the recording heads 16 shown in FIGS. 1A and 1B, viewed from the left side of the image forming apparatus of FIG. 1B in the axis direction (X-axis direction) of the guide shaft 13.

The nozzle face 101 is provided to face downward on each one of the recording heads 16. On the nozzle face 101, the plural nozzles N1, N2, . . . Nx, . . . and Nn (x and n are integers, and x<n) are arranged linearly, and thus, the nozzle hole row is formed. From each one of the nozzle holes, an ink droplet 102 is discharged according to image data and liquid discharge state detection data. The liquid discharge state detection data is obtained from the light receiving element 106 described later.

The liquid discharge state detection device 20 according to the first embodiment includes a light emitting part A and a light receiving part B.

The light emitting part A includes the light emitting element 104 that includes a semiconductor laser and a collimator lens 105 that transforms the light beam emitted by the semiconductor laser into parallel light and thus obtains the light beam 103 having the beam diameter ϕ1. The light emitting element 104 is not necessarily limited to a semiconductor laser, and it is also possible to use a light emitting diode (LED) or the like, for example, instead of a semiconductor laser.

The light receiving part B includes the light receiving element 106 that includes a photodiode or the like and the analyzer 107 that only transmits scattered light S having the same polarization direction as the polarization direction of the light beam 103 emitted by the light emitting element 104. The light receiving part B is placed at a position outside the beam diameter ϕ1 of the light beam 103 so that the light receiving surface 108 of the light receiving element 106 and the light receiving surface 109 of the analyzer 107 are not inside the beam diameter ϕ1 of the light beam 103. However, it is preferable that the light receiving part B is placed at a position adjacent to the beam diameter ϕ1.

As shown in FIG. 2, the light receiving part B is placed at a position at an angle θ1 with respect to the optical axis L of the light beam 103, and also, at the position at an angle θ (0≤θ≤θ1) with respect to the direction P perpendicular to the optical axis L.

More specifically, for example, it is assumed that a straight line S1 shown in FIG. 2 is a straight line passing through both the center of the analyzer 107 and the center of the light receiving element 106. In this case, the angle θ1 shown in FIG. 2 can be said to be the angle between the straight line S1 and the optical axis L of the light beam 103. Further, for example, it is assumed that a straight line S2 shown in FIG. 2 is a straight line passing through the center of the light receiving element 106 and perpendicular to the above-mentioned straight line S1. In this case, the angle θ shown in FIG. 2 can be said to the angle between the straight line S2 and the above-mentioned direction P perpendicular to the optical axis L.

In the image forming apparatus according to the first embodiment, the ink droplet 102 is discharged from the nozzle Nx of the nozzle face 101 of the recording heads 16, and scattered light S is generated as a result of the ink droplet 102 colliding with the light beam 103. In the liquid discharge state detection device 20 according to the first embodiment, the received light amount obtained as a result of light of the generated scattered light S reaching the light receiving surface 108 of the light receiving element 106 after passing through the light receiving surface 109 of the analyzer 107 is converted into a voltage (light-to-voltage conversion) in the light receiving element 106, and the thus obtained output voltage V is measured. Thus, the received light data of the scattered light S is obtained, and based on the obtained received light data, the liquid discharge state such as whether a discharge of the ink droplet 102 has occurred, whether the discharge of the ink droplet 102 has been shifted and/or the like is detected. This liquid discharge state is used as the liquid discharge state detection data.

Figure 3:
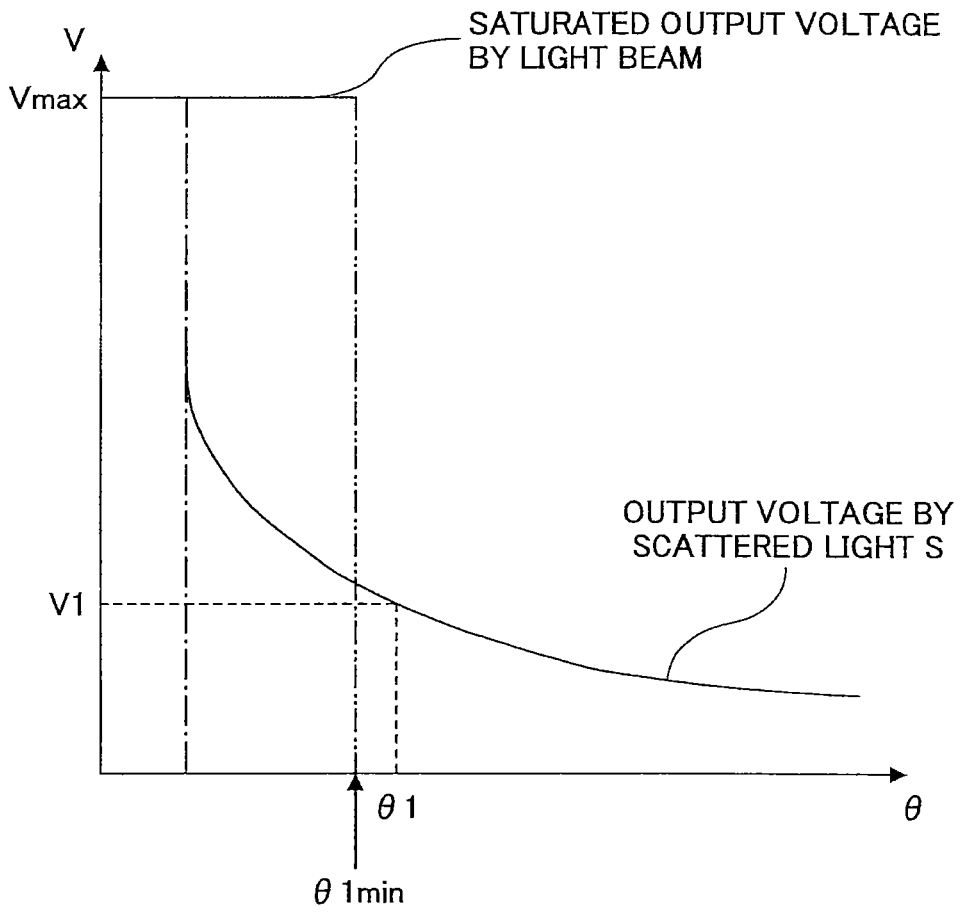
FIG. 3 shows a relationship between an angle θ1 between a light receiving element 106 and the optical axis L of a light beam 103 and the output voltage V of the light receiving element 106.

FIG. 3 shows a relationship between the angle θ (θ1) between the light receiving element 106 and the optical axis L of the light beam 103 and the output voltage V of the light receiving element 106. In FIG. 3, the abscissa axis indicates the angle θ between the light receiving element 106 and the optical axis L of the light beam 103, and the ordinate axis indicates the output voltage V of the light receiving element 106. As can be seen from FIG. 3, the output voltage V by scattered light S has angle dependency. The more the angle θ1 shown in FIG. 2 is increased, the more the output voltage V by scattered light S falls. However, when the light receiving element 106 is inside the beam diameter ϕ1 of the light beam 103 (θ≤θ1min, where ≥1min is the minimum angle between the light receiving element 106 and the optical axis L in a case where the light receiving element 106 is not inside the beam diameter ϕ1 of the light beam 103), the light beam 103 is directly incident on the light receiving element 106. The output voltage V by the light beam 103 is higher than the output voltage V1 by scattered light S, and thus, the output voltage of the light receiving element 106 enters a saturated state (Vmax) even in a state of no ink droplet being discharged. Thus, it is not possible to detect scattered light S.

Thus, the angle θ1 between the light receiving element 106 and the optical axis L should be an angle (θ1>θ1min) at which the light receiving element 106 is not inside the beam diameter ϕ1 of the light beam 103.

Further, the light receiving surface 109 of the analyzer 107 only transmits scattered light S having the same polarization direction as the polarization direction of the light beam 103 emitted by the light emitting element 104. Thus, as to light coming from the outside, reflected light from the recording medium W, the recording heads 16 and other peripheral parts and so forth (referred to as noise light N, hereinafter), only scattered light S having the same polarization direction as the polarization direction of the analyzer 107 passes through the analyzer 107 and reaches the light receiving surface 108 of the light receiving element 106.

Figure 4:
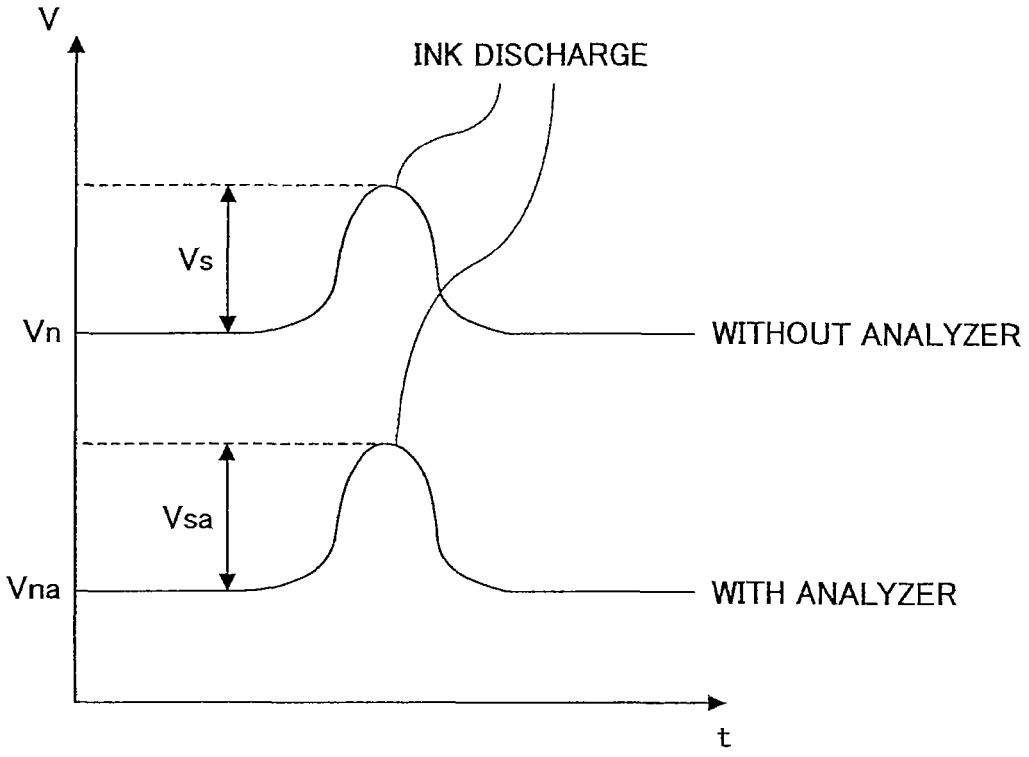
FIG. 4 shows output voltages V of the light receiving element 106 for when an analyzer 107 exists and does not exist while ink is being discharged.

FIG. 4 shows the output voltage V of the light receiving element 106 in a state of using the analyzer 107 and a state of not using the analyzer 107 at a time of a discharge of ink. The abscissa axis indicates time and the ordinate axis indicates the output voltage V of the light receiving element 106. Further, in FIG. 4, Vn denotes the output voltage by noise light N in the state of not using the analyzer 107, Vs denotes the output voltage by scattered light S in the state of not using the analyzer 107, Vna denotes the output voltage by noise light N in the state of using the analyzer 107, and Vsa denotes the output voltage by scattered light S in the state of using the analyzer 107.

The SN ratio "SN" between scattered light S and noise light N in the state of not using the analyzer 107 and the SN ratio "SNa" between scattered light S and noise light N in the state of using the analyzer 107 can be expressed as follows:

$$SN = Vs/Vn$$

$$SNa = Vsa/Vna$$

Further, these SN ratios have the following relationship:

$$\begin{aligned} SNa &= Vsa/Vna \\ &= (\tau s \cdot Vs)/(\tau n \cdot Vn) \\ &= \tau s/\tau n \cdot Vs/Vn \\ &= \tau s/\tau n \cdot SN \end{aligned}$$

In this equation, τn denotes transmittance of the analyzer 107 for noise light N, and τs denotes transmittance of the analyzer 107 for scattered light S.

The analyzer 107 only transmits scattered light S having the same polarization direction as the polarization direction of the light beam 103 emitted by the light emitting element 104. Thus, transmittance τn for noise light N and transmittance τs for scattered light S have relationship of τn<τs. Thus, SNa>SN. Thus, the SN ratio between the received light amount of the light receiving element 106 by noise light N and the received light amount of the light receiving element 106 by scattered light S is increased as a result of providing the analyzer 107. Thus, it is possible to positively detect the discharge state of the ink droplet 102.

<Advantageous Effects of Liquid Discharge State Detection Device 20 of First Embodiment>

Thus, in the liquid discharge state detection device 20 of the first embodiment, the analyzer 107 is provided, which detects scattered light S having the same polarization direction as the polarization direction of the light beam 103 emitted by the light emitting element 104, on the side of the light receiving element 106, and the light receiving element 106 receives scattered light S that has passed through the analyzer 107.

Scattered light S generated as a result of the light beam 103 colliding with the ink droplet 102 at a time of a discharge of ink has a component having the same polarization direction as the polarization direction of the light beam 103, and the component reaches the light receiving element 106 after passing through the analyzer 107. On the other hand, reflected light from the recording medium W, the recording head 16 and/or the like and disturbance light (noise light N) is not polarized, and thus, the noise light N that reaches the light receiving element 106 after passing through the analyzer 107 is reduced.

Thus, the SN ratio between the received light amount of the light receiving element 106 by the noise light N and the received light amount of the light receiving element 106 by the scattered light S is increased. Thus, it is possible to detect the discharge state of the liquid droplet 102.

It is noted that in the liquid discharge state detection device 20 of the first embodiment, it is possible to make the polarization characteristics of the light beam 103 emitted by the light emitting element 104 satisfactory in a case where a semiconductor laser is used as the light emitting element 104. As a result, it is possible to increase the received light amount of the light beam 103 that reaches the light receiving element 106 after passing through the analyzer 107. Thus, by using a semiconductor laser as the light emitting element 104, the SN ratio between the received light amount by the noise light N and the received light amount by the scattered light S is improved, and it is possible to detect the discharge state of the ink droplet 102.

Second Embodiment

Next, a second embodiment will be described.

Figure 5:
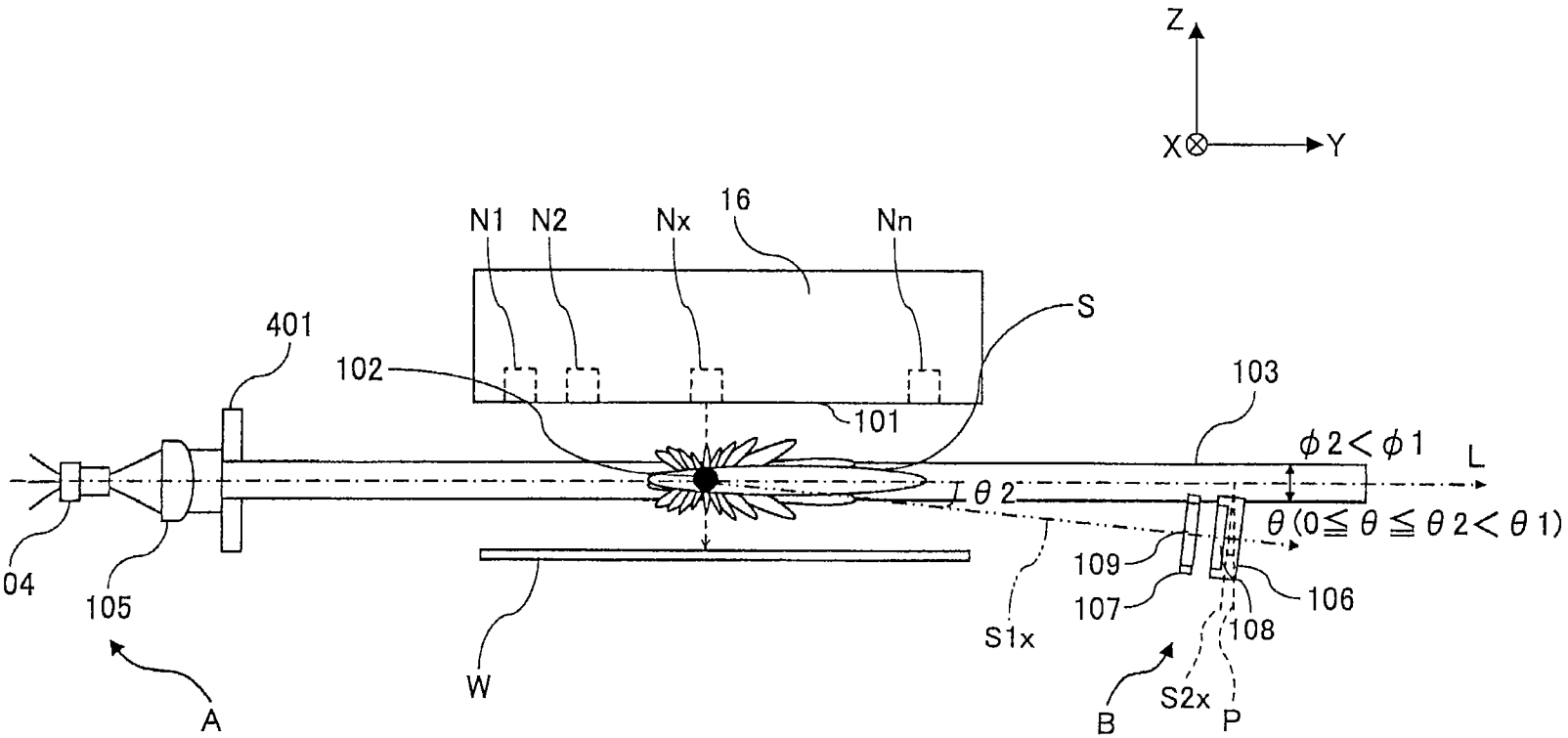
FIG. 5 shows a general configuration example of a liquid discharge state detection device 20 according to a second embodiment.

FIG. 5 shows a configuration example of a liquid discharge state detection device 20 according to the second embodiment. In the liquid discharge state detection device 20 according to the second embodiment, a diaphragm member 401 is installed on the downstream side of the direction of the light beam 103 of the collimator lens 105. The diaphragm member 401 narrows down the light beam 103 emitted by the light emitting element 104. As the diaphragm member 401, an aperture, a slit or the like, for example, can be used.

By narrowing down the light beam 103 emitted by the light emitting element 104, it is possible to make the beam diameter ϕ2 of the light beam 103 smaller than the first embodiment (ϕ2<ϕ1). As a result, it is possible to make the angle θ2 between the light receiving element 106 and the optical axis L smaller than the angle θ1 of the first embodiment (θ2<θ1).

The light receiving part B is placed at a position outside the beam diameter ϕ2 of the light beam 103 so that the light receiving surface 108 of the light receiving element 106 and the light receiving surface 109 of the analyzer 107 are not inside the beam ϕ2 of the light beam 103. However, it is preferable that the light receiving part B is placed at a position adjacent to the beam diameter ϕ2.

As shown in FIG. 5, the light receiving part B is placed at a position at the angle θ2 (θ2<θ1) with respect to the optical axis L of the light beam 103, and also, at the position at an angle θ (0≤≥≤θ2<θ1) with respect to the direction P perpendicular to the optical axis L.

More specifically, for example, it is assumed that a straight line S1*x* shown in FIG. 5 is a straight line passing through both the center of the analyzer 107 and the center of the light receiving element 106. In this case, the angle θ2 shown in FIG. 2 can be said to be the angle between the straight line S1*x* and the optical axis L of the light beam 103. Further, for example, it is assumed that a straight line S2*x* shown in FIG. 5 is a straight line passing through the center of the light receiving element 106 and perpendicular to the above-mentioned line S1*x*. In this case, the angle θ shown in FIG. 5 can be said to the angle between the straight line S2*x* and the above-mentioned direction P perpendicular to the optical axis L.

The angle θ2 between the light receiving element 106 and the optical axis L should be an angle (θ2>θ2min, where θ2min is the minimum angle between the light receiving element 106 and the optical axis L in a case where the light receiving element 106 is not inside the beam diameter ϕ2 of the light beam 103) at which the light receiving element 106 is not inside the beam diameter ϕ2 of the light beam 103.

Figure 6:
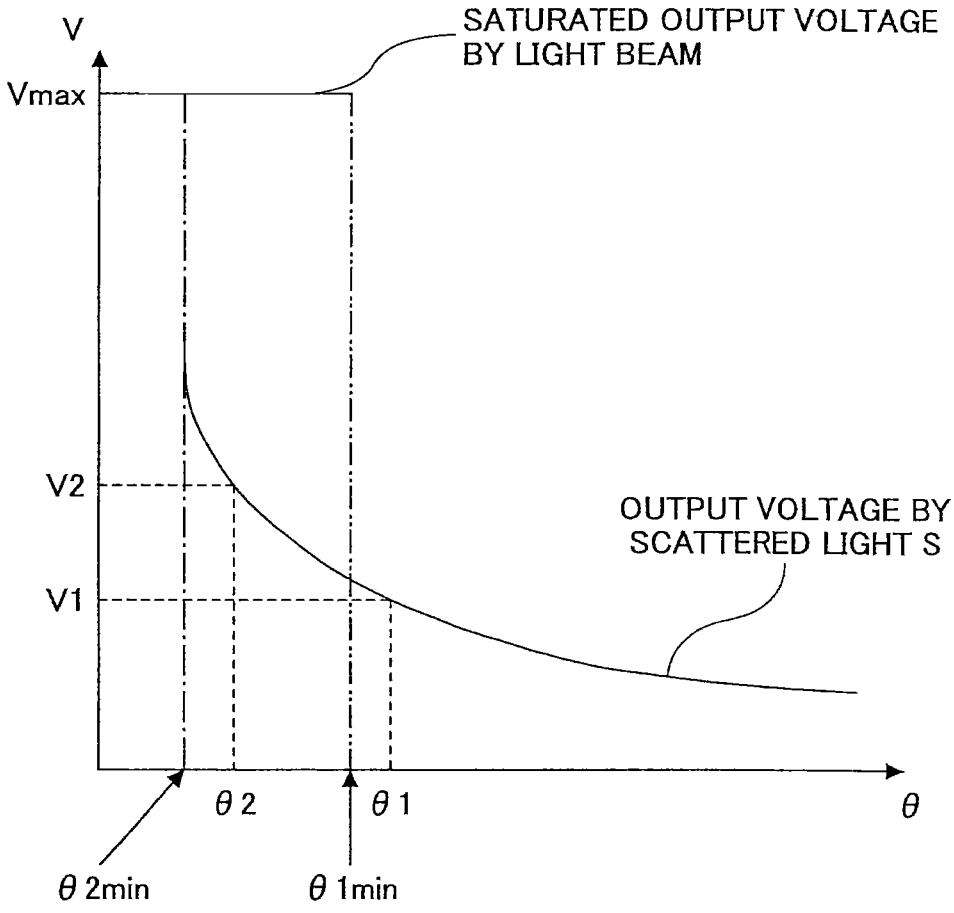
FIG. 6 shows a relationship between an angle θ2 between the light receiving element 106 and the optical axis L of the light beam 103 and the output voltage V of the light receiving element 106.

FIG. 6 shows a relationship between the angle θ (θ2) between the light receiving element 106 and the optical axis L of the light beam 103 and the output voltage V of the light receiving element 106. In FIG. 6, the abscissa axis indicates the angle θ between the light receiving element 106 and the optical axis L, and the ordinate axis indicates the output voltage V of the light receiving element 106. As can be seen from FIG. 6, the output voltage V by scattered light S has angle dependency. The more the angle θ2 is increased, the more the output voltage V by scattered light S falls. Thus, in the condition of the angle θ2 being characterized by θ2<θ1, the received light amount by scattered light S is increased. Thus, the output voltage V2 obtained from light-to-voltage conversion by the light receiving element 16 is characterized by V1<V2, where V1 denotes the output voltage at θ1, and V2 denotes the output voltage at θ2.

Further, by thus narrowing down the light beam 103 emitted by the light emitting element 104, a variation in the light intensity, a shift of the wave front and/or the like of the light beam 103 emitted by the light emitting element 104 can be reduced. Thus, also scattered light S generated as a result of the light beam 103 colliding with the ink droplet 102 becomes scattered light S in which the variation in the light intensity, the shift of the wave front and/or the like are reduced. Thus, by providing the diaphragm member 401, the SN ratio between the received light amount by the noise light N and the received light amount by the scattered light S is increased, and thus, it is possible to detect the discharge state of the ink droplet 102.

<Advantageous Effects of Liquid Discharge State Detection Device 20 of Second Embodiment>

Thus, in the liquid discharge state detection device 20 according to the second embodiment, it is possible to reduce the beam diameter ϕ2 of the light beam 103 by providing the diaphragm member 401 that narrows down the light beam 103 emitted by the light emitting element 104. Thus, it is possible to reduce the angle θ2 between the light receiving element 106 and the optical axis L of the light beam 103. Thus, the received light amount of the light receiving element 106 is increased, the SN ratio between the received light amount by the noise light N and the received light amount by the scattered light S is increased, and thus, it is possible to detect the discharge state of the ink droplet 102.

Further, by thus narrowing down the light beam 103 emitted by the light emitting element 104, a variation in the light intensity, a shift of the wave front and/or the like of the light beam 103 can be reduced. Thus, also in the scattered light S generated as a result of the light beam 103 colliding with the ink droplet 102, the variation in the light intensity, the shift of the wave front and/or the like can be reduced. Thus, a variation and/or a shift of the received light amount of the light receiving element 106 can be reduced, the detection accuracy is thus improved, and it is possible to detect the discharge state of the ink droplet 102.

Third Embodiment

Next, a third embodiment will be described.

Figure 7:
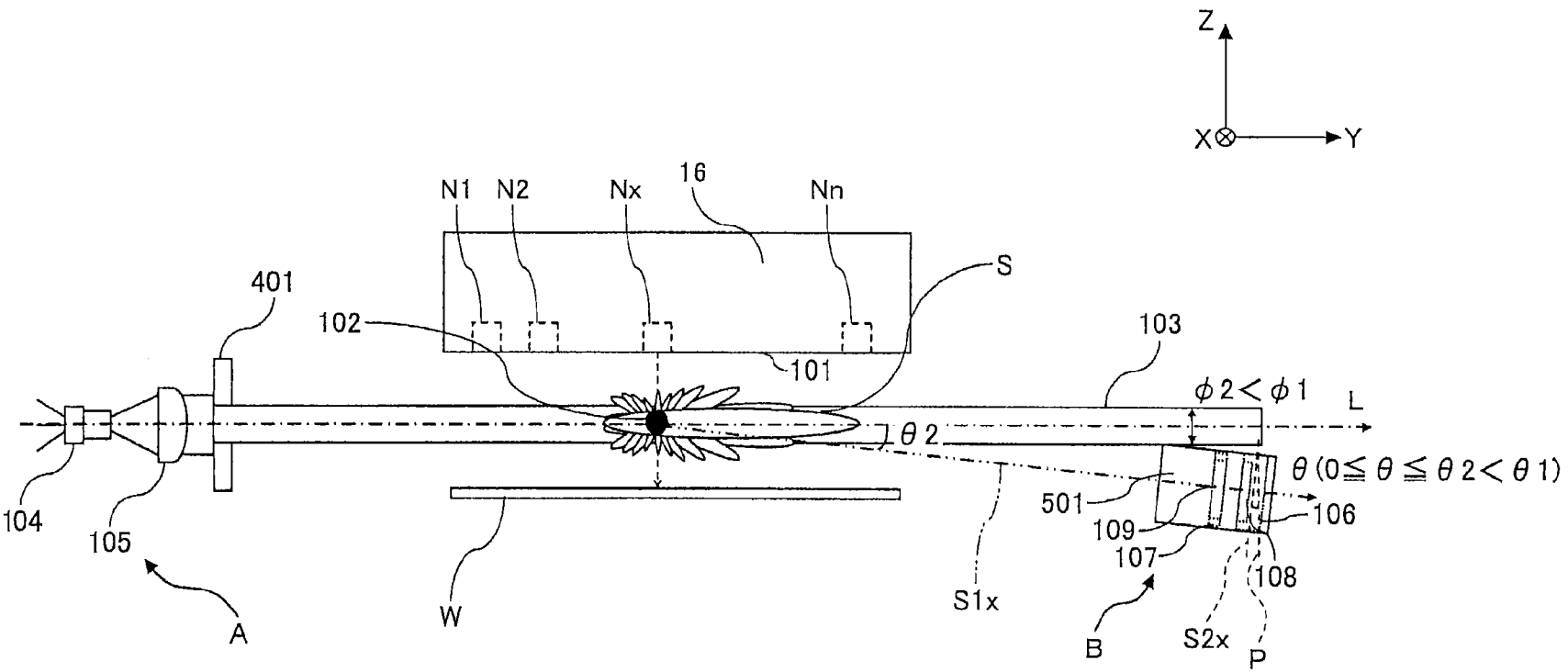
FIG. 7 shows a general configuration example of a liquid discharge state detection device 20 according to a third embodiment.

FIG. 7 shows a configuration example of a liquid discharge state detection device 20 according to the third embodiment.

The liquid discharge state detection device 20 according to the third embodiment has a light blocking pipe 501. The analyzer 107 and the light receiving element 106 are placed inside the single light blocking pipe 501.

By placing the analyzer 107 and the light receiving element 106 inside the single light blocking pipe 501, it is possible to block the noise light N admitted through, between the analyzer 107 and the light receiving element 106, and it is possible to reduce the received light amount by the noise light N. Thus, by placing the analyzer 107 and the light receiving element 106 inside the single light blocking pipe 501, the SN ratio between the received light amount by the noise light N and the received light amount by the scattered light S is increased, and thus, it is possible to detect the discharge state of the ink droplet 102.

Further, it is preferable to extend the light blocking pipe 501 in the direction toward the light emitting element 104 from the analyzer 107 to such an extent that the light beam 103 is not admitted into the light blocking pipe 501 directly. Thus, it is possible to further prevent the noise light N from being admitted, the SN ratio between the received light amount by the noise light N and the received light amount by the scattered light S is further increased, and thus, it is possible to detect the discharge state of the ink droplet 102.

<Advantageous Effects of Liquid Discharge State Detection Device 20 of Third Embodiment>

In the liquid discharge state detection device 20 of the third embodiment, the analyzer 107 and the light receiving element 106 are placed inside the single light blocking pipe 501. Thus, it is possible to prevent the disturbance light from being admitted through, between the analyzer 107 and the light receiving element 106. Thus, the SN ratio between the received light amount by the noise light N and the received light amount by the scattered light S is further increased, and thus, it is possible to detect the discharge state of the ink droplet 102.

Fourth Embodiment

Next, a fourth embodiment will be described.

Figure 8:
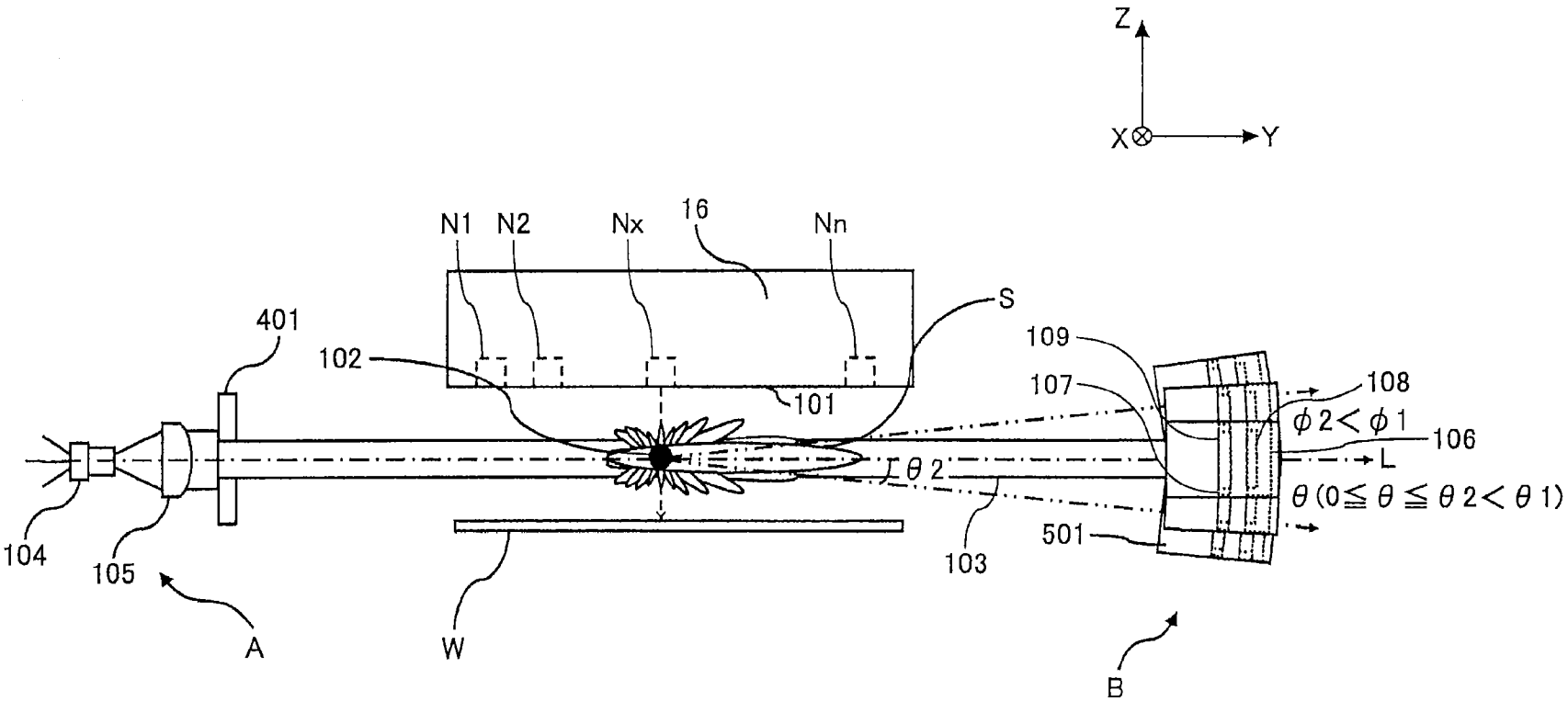
FIG. 8 shows a general configuration example of a liquid discharge state detection device 20 according to a fourth embodiment.

FIG. 8 shows a configuration example of a liquid discharge state detection device 20 according to the fourth embodiment.

In the liquid discharge state detection device 20 according to the fourth embodiment, plural light blocking pipes 501 in each one of which the analyzer 107 and the light receiving element 106 are placed inside are arranged along the outer circumference of the beam diameter ϕ2 of the light beam 103.

Figure 9:
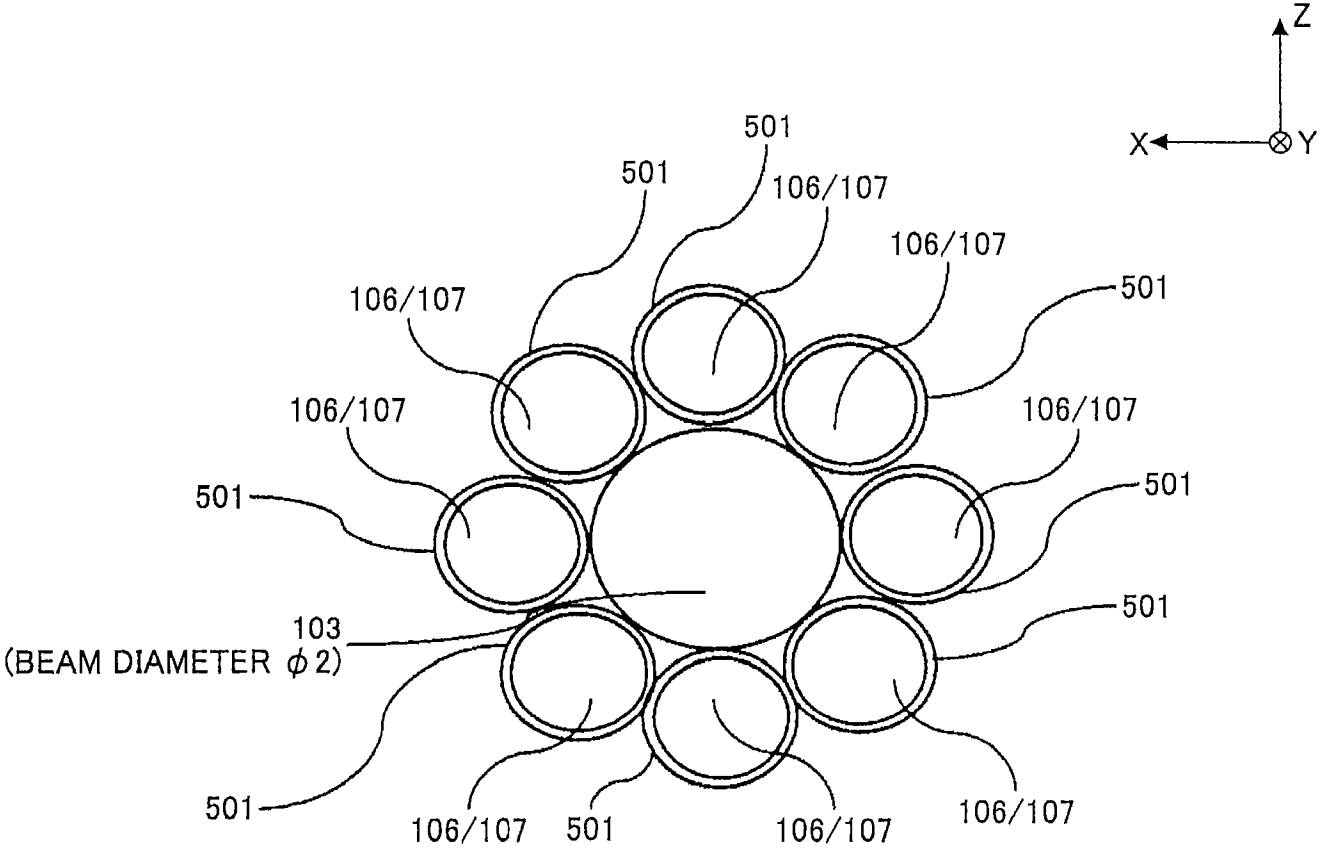
FIG. 9 shows an example in which plural light blocking pipes 501, in each one of which the analyzer 107 and the light receiving element 106 are placed, are arranged along the outer circumference of the beam diameter ϕ2 of the light beam 103.

FIG. 9 shows a view of the light blocking pipes 501 shown in FIG. 8 viewed from the side of the light emitting element 104.

FIG. 9 shows, as one example, a state of arranging the eight light blocking pipes 501 along the outer circumference of the beam diameter ϕ2 of the light beam 103. However, the shapes of the light blocking pipes 501 may be other shapes. Also, the number of the light blocking pipes 501 may be any number other than the eight.

Thus, in the liquid discharge state detection device 20 according to the fourth embodiment, the plural things, in each one of which the analyzer 107 and the light receiving element 106 are placed inside the single light blocking pipe 501, are arranged along the outer circumference of the beam diameter ϕ2 of the light beam 103. Thus, even when the amount of light of the light beam 103 emitted by the light emitting element 104 is small, the sum total of the received light amounts of the respective light receiving elements 106 can be used as the received light amount by the scattered light S to be used for the detection measurement. Thus, it is possible to increase the received light amount by the scattered light S to be used for the detection measurement.

Thus, the plural light blocking pipes 501 are arranged on the circumference of the beam diameter ϕ2 of the light beam 103. Thus, even when the amount of light of the light beam 103 emitted by the light emitting element 104 is small, the sum total of the received light amounts of the respective light receiving elements 106 can be used as the received light amount by the scattered light S. Thus, it is possible to detect the discharge state of the ink droplet 102.

Figure 10:
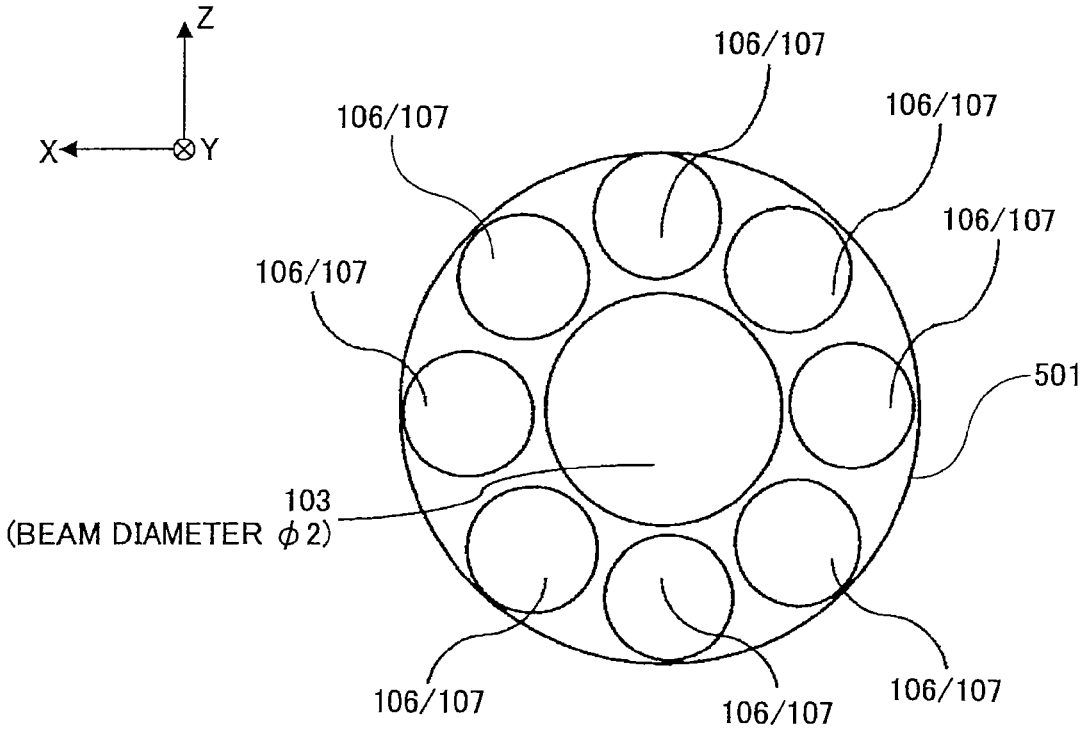
FIG. 10 shows an example in which plural analyzers 107 and light receiving elements 106 are arranged in a single light blocking pipe 501 larger than the beam diameter ϕ2 of the light beam 103.

It is noted that in FIG. 9, the plural light blocking pipes 501 are arranged along the outer circumference of the beam diameter ϕ2 of the light beam 103. However, it is also possible to arrange a plurality of the analyzers 107 and a plurality of the light receiving elements 106 inside a single light blocking pipe 501 that is larger than the beam diameter ϕ2 of the light beam 103, as shown in FIG. 10. FIG. 10 shows, as one example, a state of arranging the eight circular analyzers 107 and the eight circular light receiving elements 106. It is noted that the shapes of the analyzers 107 and the shapes of the light receiving elements 106 shown in FIG. 10 may be changed to other shapes, and the number of the analyzers 107 and the number of the light receiving elements 106 may be any other number. Further, the shape of the light blocking pipe 501 is not limited to the circle, and may be another shape.

Figure 11:
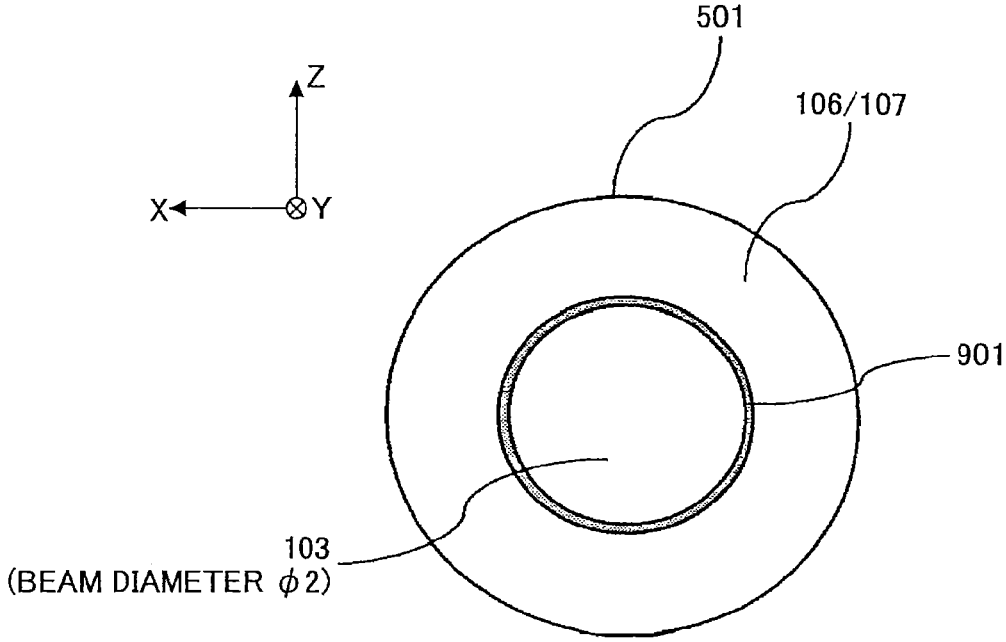
FIG. 11 shows an example in which the analyzer 107 and the light receiving element 106 are installed in a single light blocking pipe 501.

Further, it is also possible to install, as shown in FIG. 11, an analyzer 107 and a light receiving element 106 inside a single light blocking pipe 501. Each of the analyzer 107 and the light receiving element 106 has such a diameter that the extent of arranging of the plural light blocking pipes 501 along the outer circumference of the beam diameter ϕ2 of the light beam 103 as shown in FIG. 9 can be satisfied. Further, a member 901 that does not transmit the light beam 103 may be placed in the area of the beam diameter ϕ2. FIG. 11 shows, as one example, the analyzer 107, the light receiving element 106 and the circular light blocking pipe 501. However, the light blocking pipe 501 may have another shape.

<Advantageous Effects of Liquid Discharge State Detection Device 20 of Fourth Embodiment>

Thus, in the liquid discharge state detection device 20 of the fourth embodiment, the analyzer(s) 107 and the light receiving element(s) 106 are installed along the outer circumference of the beam diameter ϕ2 of the light beam 103. Thus, it is possible to increase the received light amount received by the light receiving element(s) 106 even in a case where the amount of light of the light beam 103 emitted by the light emitting element 104 is small. Thus, it is possible to detect the discharge state of the ink droplet 102.

Thus, it is possible to provide the liquid discharge state detection devices that can detect the states of liquid being discharged by the recording heads.

The liquid discharge state detection devices have been described above by the preferable embodiments. However, the present invention is not limited to these embodiments, and variations and modifications may be made without departing from the scope of the present invention.

For example, the control operations of the respective parts included in the image forming apparatus and the liquid discharge state detection device 20 can be carried out by hardware, software or a combination of both.

In a case of carrying out the control operations using software, it is possible to install a program(s) in which a processing sequence(s) is(are) recorded in a memory inside a computer that is incorporated in dedicated hardware, and cause the computer to execute the program(s). Alternatively, it is also possible to install the program(s) in a general-purpose computer that can execute various sorts of processing, and cause the computer to execute the program(s).

For example, the program(s) can be previously recorded in a hard disk or a read-only memory (ROM) as a recording medium. Alternatively, the program(s) can be stored (recorded) temporarily or permanently in a removable recording medium. Such a removable recording medium can be provided as so-called "package software". It is noted that examples of the removable recording medium include a floppy (registered trademark) disk, a compact disc read-only memory (CD-ROM), a magneto optical (MO) disc, a digital versatile disc (DVD), a magnetic disk, a semiconductor memory and so forth.

It is noted that the program(s) will be installed in a computer from the above-mentioned removable recording medium. Alternatively, the program(s) can be transferred to a computer from a download site wirelessly. Further alternatively, the program(s) can be transferred to a computer via a communication network by wire.

Further, the image forming apparatus and the liquid discharge state detection device 20 according to any one of the embodiments can be configured to be able to carry out processing according to the processing operations described above not only in a time-series manner but also in a parallel manner or individually, depending on the processing capabilities of the apparatus(s) to carry out the processing, or on an as-needed basis.

The present application is based on Japanese priority application No. 2011-269939 filed Dec. 9, 2011, the entire contents of which are hereby incorporated herein by reference.

What is claimed is:

1. A liquid discharge state detection device comprising:

a light emitting element that emits a light beam having a specific polarization direction;

a light receiving element that is placed at a position shifted from a beam diameter of the light beam, wherein the light receiving element receives scattered light generated when the light beam collides with a liquid droplet; and an analyzer positioned between the light emitting element and the light receiving element, wherein the analyzer detects scattered light having a polarization direction the same as the specific polarization direction of the light beam emitted by the light emitting element, wherein the light receiving element receives the scattered light that has passed through the analyzer and carries out light-to-voltage conversion of the received light amount obtained as a result of the scattered light reaching a light receiving surface of the light receiving element, and a discharge state of the liquid droplet is detected from measuring a voltage of the light-to-voltage conversion.

2. The liquid discharge state detection device as claimed in claim 1, further comprising a diaphragm member that narrows down the light beam emitted by the light emitting element.

3. The liquid discharge state detection device as claimed in claim 1, wherein the analyzer and the light receiving element are provided inside at least a single light blocking pipe.

4. The liquid discharge state detection device as claimed in claim 3, further comprising a plurality of the light blocking pipes that include a plurality of the analyzers and a plurality of the light receiving elements, respectively, wherein the plurality of light receiving elements receive the scattered light that has passed through the plurality of analyzers, respectively.

5. The liquid discharge state detection device as claimed in claim 1, wherein the analyzer and the light receiving element are provided along an outer circumference of the beam diameter of the light beam.

6. The liquid discharge state detection device as claimed in claim 3, wherein the analyzer and the light receiving element are provided along an outer circumference of the beam diameter of the light beam.

7. The liquid discharge state detection device as claimed in claim 4, wherein the plurality of light blocking pipes are arranged along an outer circumference of the beam diameter of the light beam.

8. The liquid discharge state detection device as claimed in claim 5, further comprising a plurality of the analyzers and a plurality of the light receiving elements which are arranged along the outer circumference of the beam diameter of the light beam, wherein the plurality of light receiving elements receive the scattered light that has passed through the plurality of analyzers, respectively.

9. An image forming apparatus, comprising the liquid discharge state detection device claimed in claim 1.

10. An image forming apparatus, comprising the liquid discharge state detection device claimed in claim 2.

11. An image forming apparatus, comprising the liquid discharge state detection device claimed in claim 3.

12. An image forming apparatus, comprising the liquid discharge state detection device claimed in claim 4.

13. An image forming apparatus, comprising the liquid discharge state detection device claimed in claim 5.

14. An image forming apparatus, comprising the liquid discharge state detection device claimed in claim 6.

15. An image forming apparatus, comprising the liquid discharge state detection device claimed in claim 7.

16. An image forming apparatus, comprising the liquid discharge state detection device claimed in claim 8.

* * * * *